US007530781B2

(12) United States Patent
Fukuchi et al.

(10) Patent No.: US 7,530,781 B2
(45) Date of Patent: May 12, 2009

(54) PUMP DEVICE

(75) Inventors: Takaki Fukuchi, Tomobe (JP); Taiji Hashimoto, Tsuchiura (JP); Kazuo Amano, Tsuchiura (JP)

(73) Assignee: Hitchi Industries Co., Ltd., Tokyo (JP)

( * ) Notice: Subject to any disclaimer, the term of this patent is extended or adjusted under 35 U.S.C. 154(b) by 781 days.

(21) Appl. No.: 11/124,136

(22) Filed: May 9, 2005

(65) Prior Publication Data

US 2005/0254943 A1 Nov. 17, 2005

(30) Foreign Application Priority Data

May 10, 2004 (JP) ..... 2004-139425

(51) Int. Cl.
*F01D 3/00* (2006.01)

(52) U.S. Cl. ..... 415/104; 415/199.1

(58) Field of Classification Search ..... 415/104–107, 415/199.1–199.3; 417/369, 424
See application file for complete search history.

(56) References Cited

U.S. PATENT DOCUMENTS 3,764,236 A * 10/1973 Carter ..... 417/372
3,895,689 A * 7/1975 Swearingen ..... 184/6.4
4,545,741 A * 10/1985 Tomioka et al. ..... 417/365
4,892,459 A * 1/1990 Guelich ..... 415/104
6,012,898 A * 1/2000 Nakamura et al. ..... 415/107
6,309,174 B1 * 10/2001 Oklejas et al. ..... 415/104

FOREIGN PATENT DOCUMENTS

| | | | |
|---|---|---|---|
| JP | 58-2497 | A | 1/1983 |
| JP | A-58-192997 | | 11/1983 |
| JP | 64-36998 | A | 2/1989 |
| JP | 64-37000 | A | 2/1989 |
| JP | A-08-296586 | | 11/1996 |
| JP | A-10-002296 | | 1/1998 |
| JP | A-11-257285 | | 9/1999 |
| JP | A-2001-503118 | | 3/2001 |

OTHER PUBLICATIONS

Japanese Office Action dated Nov. 26, 2008 including English translation (Four(4) pages).

* cited by examiner

*Primary Examiner*—Richard Edgar
(74) *Attorney, Agent, or Firm*—Crowell & Moring LLP

(57) ABSTRACT

A pump device for pressurizing a fluid to be fed, comprises: a rotary shaft, a bearing including a bearing surface adapted to face to the rotary shaft so that the rotary shaft is supported on the bearing surface in a rotatable manner, and an impeller fixed to the rotary shaft to be rotatable with the rotary shaft so that the fluid is pressurized by a rotation of the impeller.

18 Claims, 4 Drawing Sheets

PUMP DEVICE

BACKGROUND OF THE INVENTION

The present invention relates to a pump device for pumping a fluid, or particularly a pump device for pumping the fluid while the pumping device is immersed in the fluid.

In a pump as disclosed by JP-A-2001-503118 and JP-A-58-192997, a main shaft on which an impeller is mounted is supported by a hydrostatic bearing to which a fluid pressurized by the pump is supplied, and a thrust balance mechanism generates an axial force to be applied to the main shaft so that the axial force counteracts a thrust force of the main shaft.

BRIEF SUMMARY OF THE INVENTION

An object of the present invention is to provide a pump device in which an energy loss caused by a circulation of a fluid in the pump device and/or a pressure loss in the circulation of the fluid in the pump device is decreased.

According to the invention, a pump device for pressurizing a fluid to be fed, comprises: a rotary shaft, a bearing including a bearing surface adapted to face to the rotary shaft so that the rotary shaft is supported on the bearing surface in a rotatable manner, and an impeller fixed to the rotary shaft to be rotatable with the rotary shaft so that the fluid is pressurized by a rotation of the impeller.

It is preferable for decreasing a thrust force applied from the rotary shaft to the bearing that the pump device further comprises a balance disk fixed to the rotary shaft in an axial direction of the rotary shaft (and in a rotational direction of the rotary shaft) and including first and second surfaces opposed to each other in the axial direction and adapted to receive first and second pressures respectively so that a difference between the first and second pressures generates a force in the axial direction to be applied through the balance disk to the rotary shaft (to compensate or counteract another force generated by a difference in pressure of the fluid across the rotary shaft and/or the impeller in the axial direction to be applied to the rotary shaft and/or the impeller in the axial direction).

If the pump device further comprises a fluidal path one end of which is adapted to fluidally communicate with the fluid received by one of the first and second surfaces and the other end of which is adapted to fluidally communicate (without fluidly communicating through the fluid before being (taken into the impeller to be) started to be pressurized by the impeller and through the fluid fully pressurized (pressurized to the maximum pressure in the impeller or the pump device) by the impeller) with the fluid before being fully pressurized (pressurized to the maximum pressure in the impeller or the pump device) by the impeller after being (taken into the impeller to be) started to be pressurized by the impeller so that the one of the first and second surfaces is capable of receiving the pressure of the fluid more than the pressure of the fluid before starting to be pressurized by the impeller and less than the pressure of the fluid (just) after being (or when being discharged out of the impeller to be) fully pressurized (pressurized to the maximum pressure in the impeller or the pump device) by the impeller after being (taken into the impeller to be) started to be pressurized by the impeller, that is, less than the maximum pressure of the fluid in the pump device or the impeller, a pressure loss of the fluid or energy loss caused by the pressure loss and/or an necessary flow rate of the fluid caused by the pressure loss is decreased, because the difference between the first and second pressure can be kept appropriate while the fluid for keeping the difference between the first and second pressure appropriate is prevented or restrained from flowing or returning to the fluid before being (taken into the impeller to be) started to be pressurized by the impeller.

If the fluidal path one end of which is adapted to fluidally communicate with the fluid received by one of the first and second surfaces and the other end of which is adapted to fluidally communicate (without fluidly communicating through the fluid before being (taken into the impeller to be) started to be pressurized by the impeller and through the fluid fully pressurized (pressurized to the maximum pressure in the impeller or the pump device) by the impeller) with the fluid before being discharged out of the impeller after being taken into the impeller so that the one of the first and second surfaces is capable of receiving the pressure of the fluid more than the pressure of the fluid before starting to be pressurized by the impeller and less than the pressure of the fluid after being discharged out of the impeller after being taken into the impeller to be started to be pressurized by the impeller, that is, less than the maximum pressure of the fluid in the impeller or the pump device, the pressure loss of the fluid or the energy loss caused by the pressure loss and/or the necessary flow rate of the fluid caused by the pressure loss is decreased, because the difference between the first and second pressure can be kept appropriate while the fluid for keeping the difference between the first and second pressure appropriate is prevented or restrained from flowing or returning to the fluid before being (taken into the impeller to be) started to be pressurized by the impeller.

If the impeller includes a plurality of pump stages through which the fluid is capable of passing in series so that the pressure of the fluid is capable of being increased in accordance with a number of the pump stages through which the fluid passes, one end of the fluidal path is adapted to fluidally communicate with the fluid received by one of the first and second surfaces and the other end of the fluidal path is adapted to fluidally communicate (without fluidly communicating through the fluid before being (taken into the impeller to be) started to be pressurized by the impeller and through the fluid fully pressurized (pressurized to the maximum pressure in the impeller or the pump device) by the impeller) with the fluid after passing through at least one of the pump stages and before passing through all of the pump stages so that the one of the first and second surfaces is capable of receiving the pressure of the fluid more than the pressure of the fluid more than the pressure of the fluid before starting to be pressurized by the impeller and less than the pressure of the fluid after being (discharged out of the impeller to be) prevented from being pressurized by the impeller after being (taken into the impeller to be) started to be pressurized by the impeller, that is, less than the maximum pressure of the fluid in the impeller or the pump device, the pressure loss of the fluid or the energy loss caused by the pressure loss and/or the necessary flow rate of the fluid caused by the pressure loss is decreased, because the difference between the first and second pressure can be kept appropriate while the fluid for keeping the difference between the first and second pressure appropriate is prevented or restrained from flowing or returning to the fluid before being (taken into the impeller to be) started to be pressurized by the impeller.

If the pump device further comprises a fluidal passage one end of which is adapted to fluidally communicate with the fluid received by (the other) one of the first and second surfaces and the other end of which is adapted to fluidally communicate (without fluidly communicating through the fluid before being (taken into the impeller to be) started to be pressurized by the impeller) with the fluid (just) after being fully pressurized (pressurized to the maximum pressure in the impeller or the pump device) by the impeller after being (taken into the impeller to be) started to be pressurized by the impeller so that the (other) one of the first and second surfaces is capable of receiving the pressure of the fluid (just) after being fully pressurized (pressurized to the maximum pressure in the impeller or the pump device) by the impeller or discharged out of the impeller, more than the pressure of the fluid after being (taken into the impeller to be) started to be pressurized by the impeller and more than the pressure of the fluid before being fully pressurized (pressurized to the maximum pressure in the impeller or the pump device) by the impeller, the difference between the first and second pressure can be generated effectively.

If the impeller includes the plurality of pump stages through which the fluid is capable of passing in series so that the pressure of the fluid is capable of being increased in accordance with a number of the pump stages through which the fluid passes, and one end of the fluidal passage is adapted to fluidally communicate with the fluid received by (the other) one of the first and second surfaces and the other end of the fluidal passage is adapted to fluidally communicate (without fluidly communicating through the fluid before being (taken into the impeller to be) started to be pressurized by the impeller) with the fluid pressurized by passing through all of the pump stages so that the (other) one of the first and second surfaces is capable of receiving the pressure of the fluid more than the pressure of the fluid before starting to be pressurized by the impeller and more than the pressure of the fluid before being fully pressurized (pressurized to the maximum pressure in the impeller or the pump device) by the impeller after being (taken into the impeller to be) started to be pressurized by the impeller, or more than the pressure of the fluid before passing completely through all of the pump stages or passing the final one of the pump stages, the difference between the first and second pressure can be generated effectively.

The force in the axial direction generated by the difference between the first and second pressures to be applied through the balance disk to the rotary shaft may be opposite to a force in the axial direction generated by a difference in pressure across (between upstream and downstream sides of) the impeller to be applied to the rotary shaft or a force in the axial direction generated by a weight of the rotary shaft and the impeller (to be borne by the bearing).

If the pressure of the fluid received by one of the first and second surfaces is less than the pressure of the fluid received by the other one of the first and second surfaces, and the pressure of the fluid received by the one of the first and second surfaces is less than the pressure of the fluid fully pressurized (pressurized to the maximum pressure in the impeller or the pump device) by the impeller, and more than the pressure of the fluid after being (taken into the impeller to be) started to be pressurized by the impeller, the pressure of the fluid received by one of the first and second surfaces can be generated effectively.

If the pump device further comprises a motor including a rotor connected to the rotary shaft to drive rotationally the rotary shaft, and a motor chamber in which the rotor is rotatable, the pressure of the fluid in the motor chamber is less than one of the first and second pressures less than the other one of the first and second pressures (less than the pressure of the fluid just after being discharged out of the impeller or the fluid fully pressurized (pressurized to the maximum pressure in the impeller or the pump device) by the impeller), and is more than a pressure of the fluid before being (taken into the impeller to be) started to be pressurized by the impeller, so that the pressurized fluid is capable of flowing between a first chamber partially defined by the first surface and a second chamber partially defined by the second surface (from the impeller) toward the motor chamber and the fluid passing through the fluidal path as recited in each of claims 3, 4 and 5 flows through the motor chamber, the pressure of the fluid received by one of the first and second surfaces can be generated effectively. If the pump device further comprises an adjustable orifice through which the fluid after passing between a first chamber partially defined by the first surface and a second chamber partially defined by the second surface is capable of flowing into the motor chamber, and whose opening degree is changeable in accordance with a movement of the rotary shaft in the axial direction to adjust a difference between the pressure of the fluid in the motor chamber and the one of the first and second pressures so that a difference between the first and second pressures increases in accordance with a decrease in distance between the rotary shaft and the bearing in the axial direction, the pressure of the fluid received by one of the first and second surfaces can be controlled automatically to be kept appropriate. The pump device may further comprise a pressure adjuster (for example, an adjustable opening area orifice arranged downstream side of the motor chamber) for adjusting a pressure of the fluid discharged from the motor chamber.

If the pump device further comprises a bearing fluid supply path one end of which is adapted to fluidally communicate with the bearing surface, and the other end of which is adapted to fluidly communicate with the fluid pressurized by the impeller so that the fluid pressurized by the impeller is introduced onto the bearing surface to be utilized for supporting the rotary shaft on the bearing surface in the rotatable manner, the fluid for supporting the rotary shaft on the bearing surface in the rotatable manner is effectively generated.

If the other end of the bearing fluid supply path is adapted to fluidly communicate (without fluidly communicating through the fluid before being (taken into the impeller to be) started to be pressurized by the impeller and through the fluid fully pressurized (pressurized to the maximum pressure in the impeller or the pump device) by the impeller) with the fluid before being fully pressurized (pressurized to the maximum pressure in the impeller or the pump device) by the impeller after being (taken into the impeller to be) started to be pressurized by the impeller so that the bearing surface is capable of receiving the pressure of the fluid more than the pressure of the fluid before starting to be pressurized by the impeller and less than the pressure of the fluid (just) after being (or when being discharged out of the impeller to be) fully pressurized (pressurized to the maximum pressure in the impeller or the pump device) by the impeller after being (taken into the impeller to be) started to be pressurized by the impeller, that is, less than the maximum pressure of the fluid in the pump device or the impeller, the pressure loss of the fluid or the energy loss caused by the pressure loss and/or the necessary flow rate of the fluid caused by the pressure loss is decreased, because the pressure of the fluid to be supplied to the bearing surface can be kept appropriate while the fluid to be supplied to the bearing surface does not needs to be or is prevented from being, fully pressurized (pressurized to the maximum pressure in the impeller or the pump device) by the impeller.

If the other end of the bearing fluid supply path is adapted to fluidly communicate (without fluidly communicating through the fluid before being (taken into the impeller to be) started to be pressurized by the impeller and through the fluid fully pressurized (pressurized to the maximum pressure in the impeller or the pump device) by the impeller) with the fluid before being discharged out of the impeller after being taken into the impeller so that the bearing surface is capable of receiving the pressure of the fluid more than the pressure of the fluid before starting to be pressurized by the impeller and less than the pressure of the fluid after being discharged out of the impeller after being taken into the impeller to be started to be pressurized by the impeller, that is, less than the maximum pressure of the fluid in the impeller or the pump device, the pressure loss of the fluid or the energy loss caused by the pressure loss and/or the necessary flow rate of the fluid caused by the pressure loss is decreased, because the pressure of the fluid to be supplied to the bearing surface can be kept appropriate while the fluid to be supplied to the bearing surface does not needs to be or is prevented from being, fully pressurized (pressurized to the maximum pressure in the impeller or the pump device) by the impeller.

If the impeller includes a plurality of pump stages through which the fluid is capable of passing in series so that the pressure of the fluid is capable of being increased in accordance with a number of the pump stages through which the fluid passes, the other end of the bearing fluid supply path is adapted to fluidly communicate (without fluidly communicating through the fluid before being (taken into the impeller to be) started to be pressurized by the impeller and through the fluid fully pressurized (pressurized to the maximum pressure in the impeller or the pump device) by the impeller) with the fluid after passing through at least one of the pump stages and before passing through all of the pump stages so that the bearing surface is capable of receiving the pressure of the fluid more than the pressure of the fluid more than the pressure of the fluid before starting to be pressurized by the impeller and less than the pressure of the fluid after being (discharged out of the impeller to be) prevented from being pressurized by the impeller after being (taken into the impeller to be) started to be pressurized by the impeller, that is, less than the maximum pressure of the fluid in the impeller or the pump device, the pressure loss of the fluid or the energy loss caused by the pressure loss and/or the necessary flow rate of the fluid caused by the pressure loss is decreased, because the pressure of the fluid to be supplied to the bearing surface can be kept appropriate while the fluid to be supplied to the bearing surface does not needs to be or is prevented from being, fully pressurized (pressurized to the maximum pressure in the impeller or the pump device) by the impeller.

It is preferable for minimizing the pressure loss of the fluid or the energy loss caused by the pressure loss and/or the necessary flow rate of the fluid caused by the pressure loss that the other end of the bearing fluid supply path is adapted to fluidly communicate (without fluidly communicating through the fluid before being (taken into the impeller to be) started to be pressurized by the impeller and through the fluid fully pressurized (pressurized to the maximum pressure in the impeller or the pump device) by the impeller) with the fluid discharged from selected one of the pump stages, and a difference between the pressure of the fluid (directly after being) discharged from the selected one of the pump stages (and before or while being prevented from, passing further at least one of the pump stages at downstream side of the selected one of the pump stages) and a necessary pressure of the fluid to be supplied onto the bearing surface is smaller than a difference between the pressure of the fluid (directly after being) discharged from each of the other ones of the pump stages other than the selected one of the pump stages (while being prevented from passing further one of the other ones of the pump stages at downstream side of the each of the other ones of the pump stages) and the necessary pressure of the fluid. The necessary pressure of the fluid may be not less than a total amount of an environmental pressure surrounding the bearing and a pressure necessary for forming a layer of the fluid between the rotary shaft and the bearing surface to prevent the rotary shaft from contacting the bearing surface.

If the impeller includes a plurality of pump stages juxtaposed in an axial of the rotary shaft through which pump stages the fluid is capable of passing in series so that the pressure of the fluid is capable of being increased in accordance with a number of the pump stages through which the fluid passes, and the pump device further comprises a plurality of stationary guide members surrounding outer peripheries of the pump stages respectively to guide the fluid discharged respectively from the pump stages (toward respective adjacent next downstream side one(s) of the pump stages), a stationary tubular member surrounding outer peripheries of the stationary guide members stacked in the axial direction, and a fluidal path extending (radially) through the stationary tubular member to enable the fluid to communicate between the fluid discharged from one of the pump stages and at least one of the fluid on the bearing surface and the fluid received by one of the first and second surfaces so that the pressure of the at least one of the fluid on the bearing surface and the fluid received by one of the first and second surfaces can be set to an intermediate pressure more than the pressure of the fluid before being (taken into the impeller to be) started to be pressurized by the impeller and less than the pressure of the fluid fully pressurized (pressurized to the maximum pressure in the impeller or the pump device) by the impeller, an appropriate pressure of the fluid to be fluidly communicated with the at least one of the fluid on the bearing surface and the fluid received by the one of the first and second surfaces can be obtained easily without on a path for the fluid to be fluidly communicated with the at least one of the fluid on the bearing surface and the fluid received by the one of the first and second surfaces, an adjustable pressure regulator including a movable member for changing the pressure and/or an orifice whose opening degree needs to be determined precisely for obtaining the appropriate pressure of the fluid.

Other objects, features and advantages of the invention will become apparent from the following description of the embodiments of the invention taken in conjunction with the accompanying drawings.

DETAILED DESCRIPTION OF THE INVENTION

Figure 1:
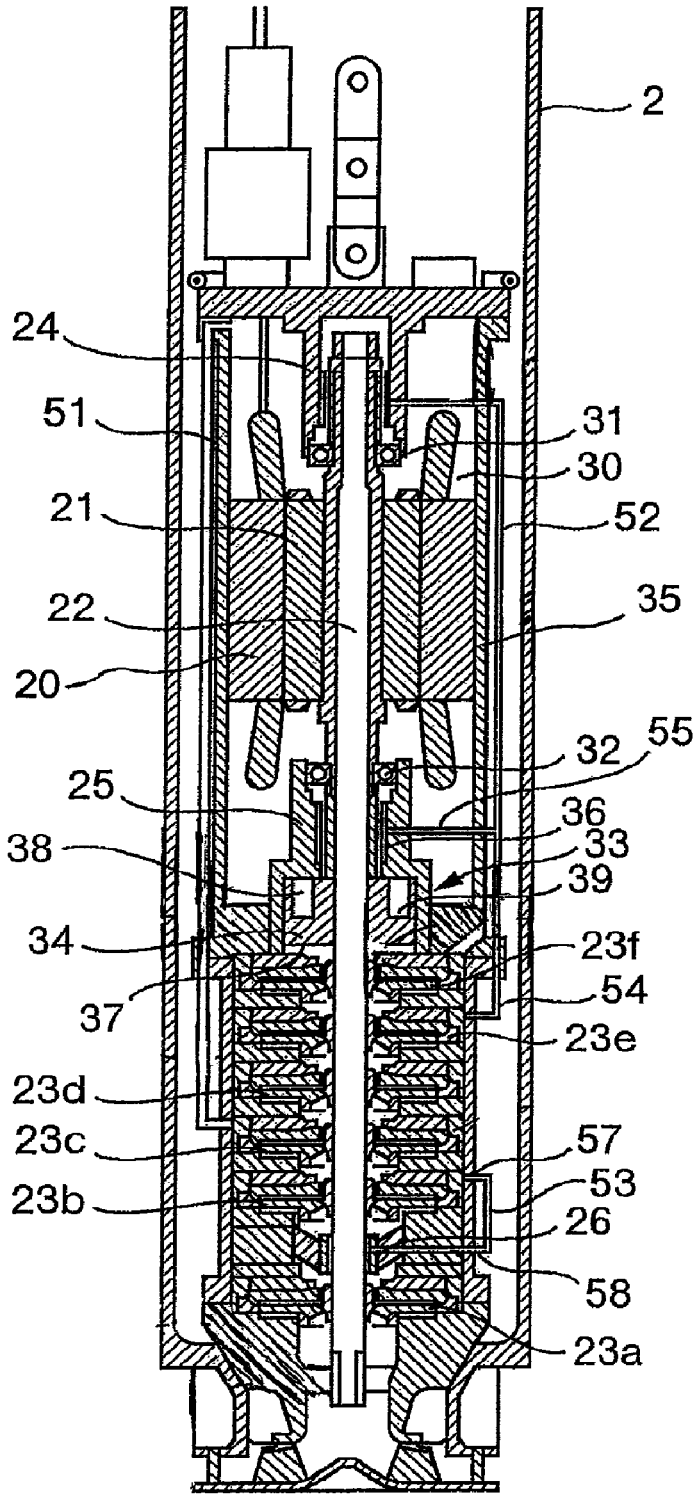
FIG. 1 is a schematic cross sectional view of a pump device as an embodiment of the invention.

As shown in FIG. 1, a pump device in a lifting tube 2 includes an electric motor 20, and a rotary shaft 22 extending at a center of the pump device is connected to a rotor of the motor 20. An impeller including pump stage impellers 23*a*-23*f* is fixed to the rotary shaft 22. Further, an inducer 41 for improving an efficiency of taking the fluid into the pump device is fixed to the rotary shaft 22 at a lower side of the first pump stage impeller 23*a*.

The rotary shaft 22 is radially supported by an upper hydrostatic bearing 24, a lower hydrostatic bearing 26 and an intermediate hydrostatic bearing 25 between the upper and lower hydrostatic bearings 24 and 26. A reason of using the hydrostatic bearings is that the hydrostatic bearings have a high vibration absorbing performance, and have a long usable life period. Each of the hydrostatic bearings 24-26 is lubricated by the fluid pressurized by the impeller Concretely, a fluid supply tube is connected to the hydrostatic bearing 24, an outlet end 55 of the fluid supply tube 52 is connected to the hydrostatic bearing 25, and a an outlet end 58 of fluid supply tube 53 is connected to the hydrostatic bearing 26 so that the pressurized fluid is supplied to each of the hydrostatic bearings 24-26. The fluid supplied to the hydrostatic bearings 24-26 is used for the lubrication of the hydrostatic bearings 24-26 and discharged from the hydrostatic bearings 24-26. Concretely, the fluid supplied to the upper and intermediate hydrostatic bearings 24 and 25 is discharged to a motor chamber 30 in which the motor 20 is arranged, and the fluid supplied to the lower hydrostatic bearing 26 arranged between the pump stage impellers 23*a* and 23*b* is discharged into the impeller.

A supporting rigidity of the hydrostatic bearing is in proportion to a pressure of the fluid supplied to the hydrostatic bearing, irrespective of a viscosity of the fluid and a rotational speed of the rotary shaft. That is, the fluid needs to have a pressure determined in accordance with a desired degree of the supporting rigidity.

In the hydrostatic bearing to which the fluid pressurized by the pump device is supplied, a sufficient bearing performance is not obtainable when the pump device starts to be driven or is stopped so that the pressure of the fluid is insufficient. Therefore, as supplemental bearings on the start or stop of the pump device, a ball bearing 31 is arranged in the vicinity of the upper hydrostatic bearing 24, and a ball bearing 32 is arranged in the vicinity of the intermediate hydrostatic bearing 25. Incidentally, the ball bearings 31 and 32 may be eliminated.

An axial thrust force generated by a difference in pressure across the impeller is applied to the rotary shaft so that the rotary shaft is urged downwardly. Further, a downward urging force generated by weights of the rotor 21, impeller 23-and the rotary shaft 22 is applied to the rotary shaft. Therefore, a thrust balance device 33 for applied a balancing thrust force against the axial thrust force and the downward urging force to be applied to the rotary shaft is arranged to decrease a thrust force applied to the hydrostatic and ball bearings.

The thrust balance device 33 includes a balance disk 34 fixed to the rotary shaft 22, and a housing 36 fixed to a casing 35 of the pump device and surrounding side and back surfaces of the balance disk 34.

The balance disk 34 has a front surface 37 facing to the impeller and a back surface 38 opposite to the front surface 37 in the axial direction and forming a balance chamber 39 with the housing 36. The balance disk 34 receives a high pressure P1 of the fluid pressurized by all of the pump stage impellers at the front surface 37, and a low pressure P2 of the fluid less than the high pressure P1 at the back surface 38, SO that the balancing thrust force is generated by a difference between the high pressure P1 and the low pressure P2. The low pressure P2 is generated by the fluid flowing into the balance chamber 39 from the fluid pressurized by all of the pump stage impellers through a small clearance (not shown) between the balance disk 34 and the housing 36 and flowing out of the balance chamber 39 to the motor chamber 30 through another clearance (not shown) between the back surface 38 and the housing 36, SO that the low pressure P2 is determined in accordance with a flow resistance of the another clearance. The another clearance is decreased by an upward movement of the rotary shaft to increase the flow resistance when the low pressure P2 is decreased, so that the increase of the flow resistance causes an increase of the low pressure P2 to urge the rotary shaft downwardly, and the another clearance is increased by a downward movement of the rotary shaft to decrease the flow resistance when the low pressure P2 is increased, so that the decrease of the flow resistance causes a decrease of the low pressure P2 to urge the rotary shaft upwardly, whereby a balancing operation occurs on the balance disk 34.

The fluid discharged into the motor chamber 30 through the thrust balance device 33 cools the motor with the fluid discharged into the motor chamber 30 from the hydrostatic bearings 24 and 25.

The pressure of the fluid in the motor chamber 30 or the balance chamber 39 is kept at an appropriate degree, that is, the fluid in the motor chamber 30 or the balance chamber 39 is communicated through a return path 51 with the fluid discharged after passing through at least one of the pump stage impellers 23*a*-23*f* and before passing through all of the pump stage impellers 23*a*-23*f*, concretely, with the fluid discharged to a clearance between a stationary tubular member and a plurality of stacked stationary guide members whose outer peripheries are surrounded by the stationary tubular member to form the clearance, and which surround outer peripheries of the impeller, that is, the stacked pump stage impellers 23*a*-23*f* to guide the fluid discharged from one of the pump stage impellers 23*a*-23*f* to next or downstream one of the pump stage impellers 23*a*-23*f* to be further or in order pressurized, at an appropriate axial position at which the pressure of the fluid discharged or leaked from the impeller is substantially equal or slightly lower than a desirable pressure of the fluid in the motor chamber 30 or the balance chamber 39 to keep the pressure of the fluid in the motor chamber 30 or the balance chamber 39 at the desirable degree.

A desirable pressure to be kept in the motor chamber 30 relates to the pressure P2 in the balance chamber 39 for the balance disk 34 which pressure P2 should be changed to generate an appropriate axial force which is applied to the rotary shaft to minimize an axial force of the rotary shaft to be borne by the thrust bearing. That is, the autonomous balancing action of the balance disk 34 is obtained by a self-sustaining adjustable leakage of the fluid from the balance chamber 39 for the balance disk 34 into the motor chamber 30. (If the autonomous balancing action of the balance disk 34 is obtained without the self-sustaining adjustable leakage of the fluid from the balance chamber 39 for the balance disk 34 into the motor chamber 30, that is, with an automatic pressure control for the balance chamber 39 through a servo-pressure electric or hydraulic control on the basis of a position of the rotary shaft and/or the axial force of the rotary shaft to be borne by the thrust bearing, measured electrically of hydraulically, the leakage of the fluid from the balance chamber 39 for the balance disk 34 into the motor chamber 30 is not necessary.) Therefore, a differential pressure PΔ between the pressure P2 of the balance chamber 39 and the pressure P3 of the motor chamber for obtaining the leakage therebetween is needed, and should be considered to determine the desirable pressure to be kept in the motor chamber 30. Concretely, the desirable pressure to be kept in the motor chamber 30 is determined is made as close as possible to the pressure in the balance chamber 39 while keeping the differential pressure PΔ between the pressure P2 of the balance chamber 39 and the pressure P3 of the motor chamber. Therefore, the pressure P3 in the motor chamber is determined to satisfy a relationship of P2−PΔ=P3>P4 when P4 is the pressure of the fluid before being pressurized by the impeller. If the fluid is discharged into the motor chamber 30 from the hydrostatic bearing(s), the discharged fluid from the hydrostatic bearing(s) affects the desirable pressure to be kept in the motor chamber 30, as described below.

In this embodiment, since the desirable pressure to be kept in the motor chamber 30 is close to the pressure of the fluid discharged from the third pump stage impeller 23*c*, the return tube 51 fluidaly connects the motor chamber 30 to the clearance between the stationary tubular member and the stationary guide members at a position to which the fluid discharged from the third pump stage impeller 23*c* flows, so that the pressure I the motor chamber 30 is substantially equal to the pressure of the fluid discharged from the third pump stage impeller 23*c*.

Next, a structure for supplying the fluid as the lubricant to the hydrostatic bearings will be explained. In the present invention, the fluid as the lubricant is supplied to each of the hydrostatic bearings from one of the pump stage impellers 23*a*-23*f* from which the fluid of the pressure closest to a total amount Pc (=Pa+Pb) of the environmental pressure Pa of the each of the hydrostatic bearings and a differential pressure Pb needed by the each of the hydrostatic bearings is discharged, and the fluid of the pressure Px≧Pc is discharged. Concretely in FIG. 1, the differential pressure Pb needed by each of the upper hydrostatic bearing 24 and the intermediate hydrostatic bearing 25 is obtained by two of the pump stage impellers 23*a*-23*f*, and the pressure in the motor chamber 30 as the environmental pressure of the upper hydrostatic bearing 24 and the intermediate hydrostatic bearing 25 is substantially equal to the pressure of the fluid discharged from the third pump stage impellers 23*c*. Therefore, the fluid discharged from the fifth pump stage impellers 23*e* is supplied to the upper hydrostatic bearing 24 and the intermediate hydrostatic bearing 25 through a fluid supply tube 52. Concretely, an intake end 54 of the fluid supply tube 52 fluidly communicates through the clearance between the stationary tubular member and the stationary guide members with the fluid discharged from the fifth pump stage impellers 23*e*. The fluid as the lubricant is supplied to the upper hydrostatic bearing 24 and the intermediate hydrostatic bearing 25 through an outlet end 55 of the fluid supply tube 52 for the intermediate hydrostatic bearing 25 and an outlet end 56 of the fluid supply tube 52 for the upper hydrostatic bearing 24 respectively.

On the other hand, the differential pressure Pb needed by the lower hydrostatic bearing 26 is substantially equal to the pressure of the fluid discharged from the first pump stage impeller, and the environmental pressure Pa of the lower hydrostatic bearing 26 is the pressure of the fluid discharged from the first pump stage impeller 23*a*. Therefore, the fluid as the lubricant discharged from the second pump stage impeller 23*b* is supplied to the lower hydrostatic bearing 26 through a fluid supply tube 53. Concretely, an intake end 57 of the fluid supply tube 53 fluidly communicates through the clearance between the stationary tubular member and the stationary guide members with the fluid discharged from the second pump stage impellers 23*b*, and the fluid as the lubricant is supplied to the lower hydrostatic bearing 26 through an outlet end 58 of the fluid supply tube 53.

In the structure for supplying the fluid as the lubricant to the hydrostatic bearings as described above, when the fluid as the lubricant leaks from the hydrostatic bearings into the motor chamber 30, the fluid as the lubricant affects the environmental pressure Pa of the hydrostatic bearings, so that the pressure of the motor chamber heeds to be considered. Therefore, the pressure in the motor chamber 30 needs to be set in such a manner that the pressure Pc as the total amount of the environmental pressure Pa of the hydrostatic bearings and the differential pressure Pb needed by the hydrostatic bearings is obtainable from the fluid discharged from the final pump stage impeller when the pressure in the motor chamber 30 affects the environmental pressure Pa of the hydrostatic bearings, whereby this needs to be considered when the desirable pressure to be kept in the motor chamber 30 is determined.

By the above structures, the following effects are obtainable. One is a decrease in flow rate of the fluid circulating in the pump device. That is, by keeping the pressure in the motor chamber 30 at the desirable pressure as described above, the difference in pressure between the motor chamber 30 and the balance chamber 39 is kept at the PΔas the minimum value for the leakage for the balancing operation, so that the leakage is significantly decreased in comparison with the prior art. Therefore, the leakage flow rate from the balance disk 34 is decreased, so that the flow rate of the fluid circulating in the pump device is decreased to improve a pumping efficiency.

Another one is a decrease of a circulation length of the fluid in the pump device. That is, the structure of the embodiment in which the fluid returns from the motor chamber 30 through the return path 51 to the fluid discharged from the intermediate pump stage impeller to keep the pressure in the motor chamber 30 at the desirable degree, causes the decrease of the circulation length of the fluid in the pump device for obtaining the balancing operation of the thrust balancing device 33. Further, since the fluid as the lubricant for the hydrostatic bearings is supplied from one of the pump stage impellers generating the pressure of the fluid needed for the hydrostatic bearings over the environmental pressure of the hydrostatic bearings, the circulation length of the fluid in the pump device is decreased. Particularly, when the fluid as the lubricant is supplied from selected one of the pump stage impellers and the fluid returns from the motor chamber to the fluid discharged from the intermediate pump stage impeller as the embodiment, the circulation length of the fluid in the pump device is decreased to the minimum value. By the decrease of the circulation length of the fluid in the pump device, the pumping efficiency is further improved.

Another one is a facilitation on designing the supply of the fluid as the lubricant for the hydrostatic bearings. That is, the desired pressure of the fluid as the lubricant is obtained from the selected one of the pump stage impellers without means for adjusting the pressure such as orifice, valve or the like on the fluidal path toward the hydrostatic bearing, so that the design of the supply of the fluid as the lubricant is facilitated.

Figure 2:
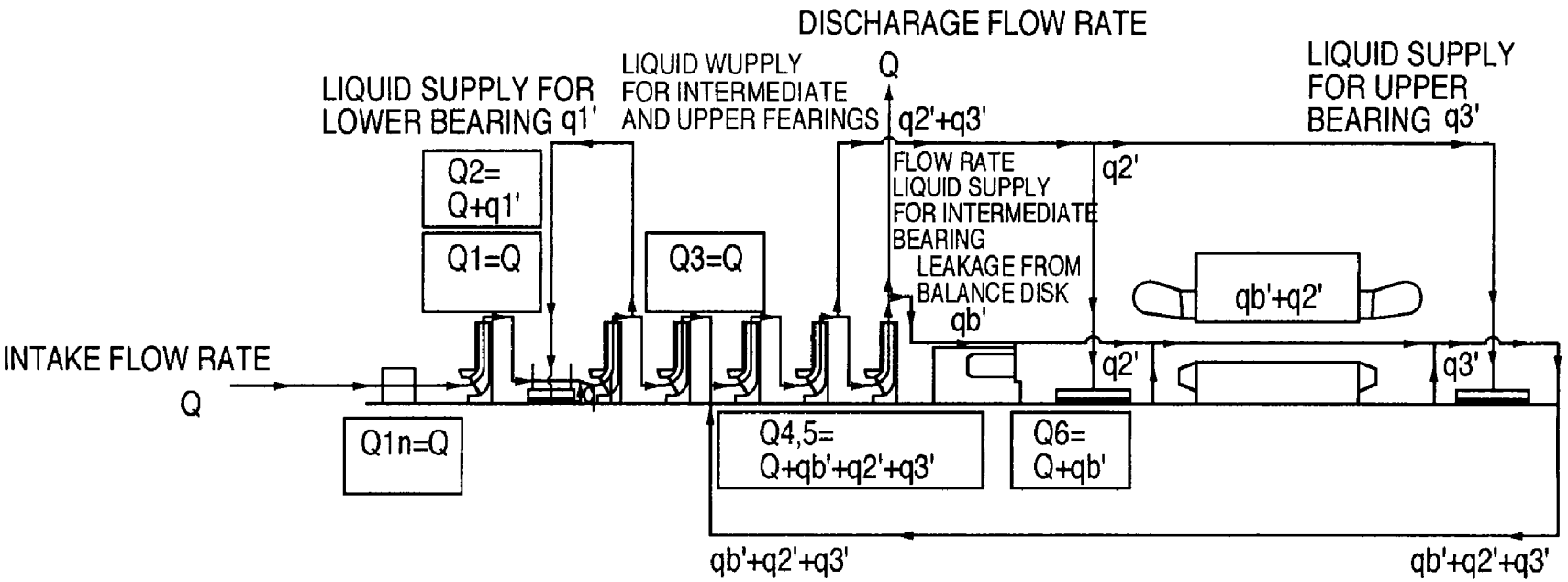
FIG. 2 is a schematic diagram showing flow courses of fluid and flow rates along the respective flow courses in the pump device.
Figure 3:
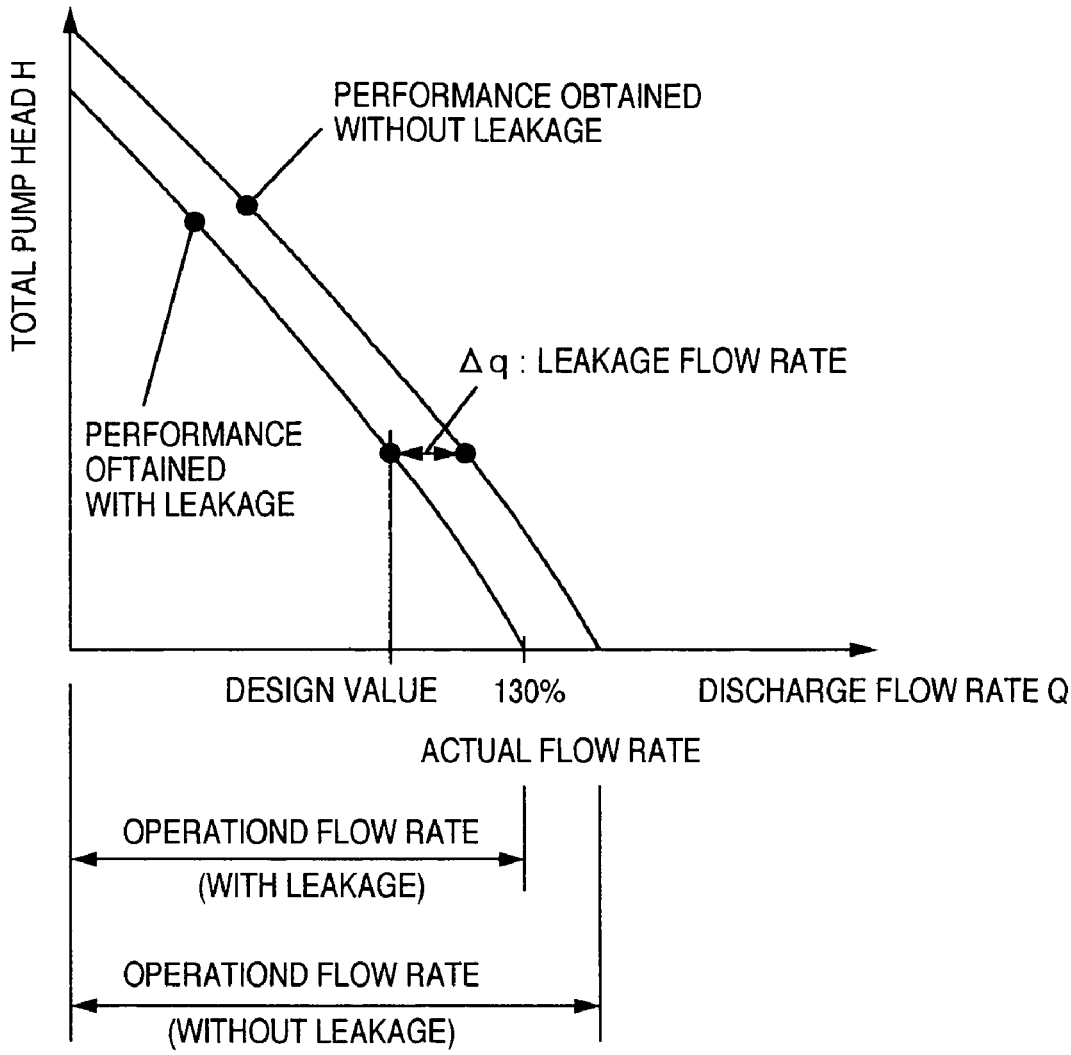
FIG. 3 is a diagram showing a performance curve of an inducer in each of a case with a leakage of fluid in the pump device and a case without the leakage of fluid in the pump device.

Hereafter, the improvement of the pumping efficiency caused by the above mentioned decrease of the circulation length of the fluid in the pump device will be explained concretely. FIG. 2 is the schematic diagram showing the flow courses of fluid and the flow rates along the respective flow courses in the pump device. Signs in FIG. 2 denote as follows, Q: intake flow rate of the pump device (decreasing flow rate from storage tank) and discharged flow rate of the pump device, Qin: flow rate of inducer, Q1-Q6: flow rate of each pump stage impeller, q1': flow rate of fluid as lubricant for lower hydrostatic bearing in the pump device of the invention, q2': flow rate of fluid as lubricant for intermediate hydrostatic bearing in the pump device of the invention, q3': flow rate of fluid as lubricant for upper hydrostatic bearing in the pump device of the invention (flow rate of fluid discharged from the upper hydrostatic bearing), and qb': flow rate of fluid leaking from the balance disk of the pump device of the invention. In this circumstance, flow rate supplied to hydrostatic bearing is flow rate discharged from hydrostatic bearing.

A loss in flow rate of the fluid circulating in the pump device in the flow courses of fluid and the flow rates along the respective flow courses in the pump device as shown in FIG. 2 is calculated along the following formula.

$$\sum \frac{Qn - Q}{Q} \times \frac{100}{N} = \frac{(Q1 + Q2 + Q3 + Q4 + Q5 + Q6) - 6Q}{Q} \times \frac{100}{N} = \frac{\frac{3}{6}qb' + \frac{2}{6}q1' + \frac{2}{6}q2' + \frac{2}{6}q3'}{Q} \times \frac{100}{N}(\%)$$

The calculated loss in flow rate of the fluid circulating in the pump device is significantly improved in comparison with the prior art. The improvement in the loss in flow rate of the fluid circulating in the pump device is more than the improvement in the loss at each leakage portions. For example, the affect caused by the leakage at the balance disk is decreased by ⅜ in comparison with the prior art, and further, the decrease in flow rate of the leaking fluid at the balance dram is added, so that the significant improvement of pumping efficiency is obtained. Incidentally, in the formula, N denotes a number of the pump stage impellers, and N=6 in the embodiment.

The decrease in flow rate of the leaking fluid at the balance disk and the decrease of the circulation length of the fluid in the pump device as described above bring about a good result for the inducer 41. The flow rate of the fluid at the inducer 41 is Qin=Q, so that it is significantly decreased in comparison with the prior art.

Figure 4:
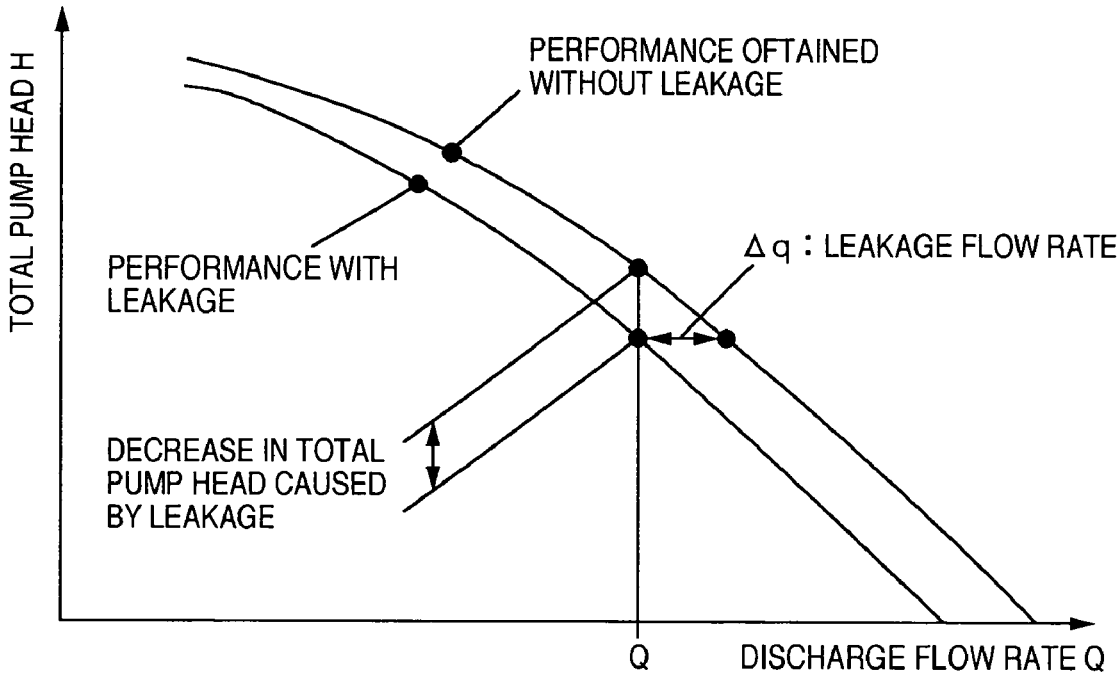
FIG. 4 is a diagram showing a performance curve of the pump device in each of a case with a leakage of fluid in the pump device and a case without the leakage of fluid in the pump device.

The performance curve of the inducer is shown in FIG. 4. As shown in FIG. 4, a pump head characteristic of the inducer has a large QH gradient. Therefore, if the loss in flow rate of the fluid circulating in the pump device caused by, for example, the leakage of the fluid at the balance disk and the fluid supply to the hydrostatic bearing, is 10%, an increase in pressure by the inducer becomes zero at the flow rate of about 130% from a design point. That is, at this flow rate, the pressure for improving an intake performance of the impeller cannot be supplied to the impeller. Therefore, normally the upper limit thereof is set at, for example, 120% to have a sufficient margin with respect to an operational range of the pump device, so that the operable range is limited. If the pump needs to be operated at an operational range more than 120% of the flow rate, a size of the inducer needs to be increased similarly so that a design flow rate is shifted to enable the pump to be operated at a larger flow rate. However, in this case, an attachment member for the inducer needs to be enlarged in accordance with the increase in size of the inducer, so that weight and cost are increased.

on the other hand, if the flow rate across the inducer is decreased as obtainable in the invention, the operational range is enlarged to enable the pressure increase for improving the intake performance of the impeller to be obtained at the flow rate range of, for example, about 130%, so that the inducer does not need to be enlarged, and size and weight of the pump device can be decreased while keeping the performance unchanged.

A pressure adjusting means such as an orifice, valve or the like may be arranged in the return path from the motor chamber so that the pressure in the motor chamber is kept at the desired degree. The pressure adjusting means in the return path for setting the pressure in the motor chamber at the desired degree has a benefit of that a difference between the pressure in the motor chamber and the pressure in the balance chamber for the balance disk can be adjusted precisely.

Although the above embodiment has the hydrostatic bearing and the thrust balancing device, the invention can be applied to the pump device having at least one of the hydrostatic bearing and the thrust balancing device.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A pump device for pressurizing a fluid to be fed, comprising:

a rotary shaft, a bearing including a bearing surface adapted to face to the rotary shaft so that the rotary shaft is supported on the bearing surface in a rotatable manner, an impeller fixed to the rotary shaft to be rotatable with the rotary shaft so that the fluid is pressurized by a rotation of the impeller, a balance disk fixed to the rotary shaft in an axial direction of the rotary shaft and including first and second surfaces opposed to each other in the axial direction and configured to receive first and second pressures, respectively, so that a difference between the first and second pressures generates a force in the axial direction to be applied through the balance disk to the rotary shaft, a motor including a rotor connected to the rotary shaft to rotationally drive the rotary shaft, and a motor chamber in which the rotor is rotatable, wherein the pressure of the fluid in the motor chamber is less than one of the first and second pressures less than the other one of the first and second pressures, and is more than a pressure of the fluid before being started to be pressurized by the impeller.

2. A pump device according to claim 1, further comprising a fluidal path one end of which is adapted to fluidally communicate with the fluid received by one of the first and second surfaces and the other end of which is adapted to fluidally communicate with the fluid before being fully pressurized by the impeller after being started to be pressurized by the impeller.

3. A pump device according to claim 1, further comprising a fluidal path one end of which is adapted to fluidally communicate with the fluid received by one of the first and second surfaces and the other end of which is adapted to fluidally communicate with the fluid before being discharged out of the impeller after being taken into the impeller.

4. A pump device according to claim 1, further comprising a fluidal path, wherein the impeller includes a plurality of pump stages through which the fluid is capable of passing in series so that the pressure of the fluid is capable of being increased in accordance with a number of the pump stages through which the fluid passes, one end of the fluidal path is adapted to fluidally communicate with the fluid received by one of the first and second surfaces and the other end of the fluidal path is adapted to fluidally communicate with the fluid after passing through at least one of the pump stages and before passing through all of the pump stages.

5. A pump device according to claim 1, further comprising a fluidal passage one end of which is adapted to fluidally communicate with the fluid received by one of the first and second surfaces and the other end of which is adapted to fluidally communicate with the fluid after being fully pressurized by the impeller after being started to be pressurized by the impeller.

6. A pump device according to claim 1, further comprising a fluidal passage, wherein the impeller includes a plurality of pump stages through which the fluid is capable of passing in series so that the pressure of the fluid is capable of being increased in accordance with a number of the pump stages through which the fluid passes, and one end of the fluidal passage is adapted to fluidally communicate with the fluid received by one of the first and second surfaces and the other end of the fluidal passage is adapted to fluidally communicate with the fluid pressurized by passing through all of the pump stages.

7. A pump device according to claim 1, wherein the force in the axial direction generated by the difference between the first and second pressures to be applied through the balance disk to the rotary shaft is opposite to a force in the axial direction generated by a difference in pressure across the impeller to be applied to the rotary shaft.

8. A pump device according to claim 1, wherein the force in the axial direction generated by the difference between the first and second pressures to be applied through the balance disk to the rotary shaft is opposite to a force in the axial direction generated by a weight of the rotary shaft and the impeller.

9. A pump device according to claim 1, wherein the pressure of the fluid received by one of the first and second surfaces is less than the pressure of the fluid received by the other one of the first and second surfaces, less than the pressure of the fluid fully pressurized by the impeller and more than the pressure of the fluid after being started to be pressurized by the impeller.

10. A pump device according to claim 1, further comprising an adjustable orifice through which the fluid after passing between a first chamber partially defined by the first surface and a second chamber partially defined by the second surface is capable of flowing into the motor chamber, and whose opening degree is changeable in accordance with a movement of the rotary shaft in the axial direction to adjust a difference between the pressure of the fluid in the motor chamber and the one of the first and second pressures so that a difference between the first and second pressures increases in accordance with a decrease in distance between the rotary shaft and the bearing in the axial direction.

11. A pump device according to claim 1, further comprising a pressure adjuster for adjusting a pressure of the fluid discharged from the motor chamber.

12. A pump device according to claim 1, further comprising a bearing fluid supply path one end of which is adapted to fluidally communicate with the bearing surface, and the other end of which is adapted to fluidly communicate with the fluid pressurized by the impeller.

13. A pump device according to claim 12, wherein the other end of the bearing fluid supply path is adapted to fluidly communicate with the fluid before being fully pressurized by the impeller after being started to be pressurized by the impeller.

14. A pump device according to claim 12, wherein the other end of the bearing fluid supply path is adapted to fluidly communicate with the fluid before being discharged out of the impeller after being taken into the impeller.

15. A pump device according to claim 12, wherein the impeller includes a plurality of pump stages through which the fluid is capable of passing in series so that the pressure of the fluid is capable of being increased in accordance with a number of the pump stages through which the fluid passes, the other end of the bearing fluid supply path is adapted to fluidly communicate with the fluid after passing through at least one of the pump stages and before passing through all of the pump stages.

16. A pump device according to claim 15, wherein the other end of the bearing fluid supply path is adapted to fluidly communicate with the fluid discharged from selected one of the pump stages, and a difference between the pressure of the fluid discharged from the selected one of the pump stages and a necessary pressure of the fluid to be supplied onto the bearing surface is smaller than a difference between the pressure of the fluid discharged from each of the other ones of the pump stages other than the selected one of the pump stages and the necessary pressure of the fluid.

17. A pump device according to claim 16, wherein the necessary pressure of the fluid is not less than a total amount of an environmental pressure surrounding the bearing and a pressure necessary for forming a layer of the fluid between the rotary shaft and the bearing surface to prevent the rotary shaft from contacting the bearing surface.

18. A pump device according to claim 1, wherein the impeller includes a plurality of pump stages juxtaposed in an axial of the rotary shaft through which pump stages the fluid is capable of passing in series so that the pressure of the fluid is capable of being increased in accordance with a number of the pump stages through which the fluid passes, and the pump device further comprises a plurality of stationary guide members surrounding outer peripheries of the pump stages respectively to guide the fluid discharged respectively from the pump stages, a stationary tubular member surrounding outer peripheries of the stationary guide members stacked in the axial direction, and a fluidal path extending through the stationary tubular member to enable the fluid to communicate between the fluid discharged from one of the pump stages and at least one of the fluid on the bearing surface and the fluid received by one of the first and second surfaces.

* * * * *